United States Patent [19]

Porel

[11] Patent Number: 5,032,061

[45] Date of Patent: Jul. 16, 1991

[54] HYDRAULIC PUMPS

[75] Inventor: Louis C. Porel, Rambervillers, France

[73] Assignee: Hydro Rene Leduc, France

[21] Appl. No.: 158,007

[22] Filed: Feb. 19, 1988

[30] Foreign Application Priority Data

Feb. 20, 1987 [FR] France ..... 87 02238

[51] Int. Cl.[5] ..... F04B 1/26

[52] U.S. Cl. ..... 417/270; 417/297; 92/12.2

[58] Field of Search ..... 417/270, 297, 426, 427, 417/428; 92/12.2; 91/506, 499

[56] References Cited

U.S. PATENT DOCUMENTS

| | | | |
|---|---|---|---|
| 2,464,448 | 3/1949 | Huber | 417/270 |
| 2,682,227 | 6/1954 | Burris | 417/297 |
| 2,806,430 | 9/1957 | Osborne | 417/270 |
| 3,093,081 | 6/1963 | Budzich | 417/222 |
| 4,519,750 | 5/1985 | Kurahashi | 417/270 |
| 4,799,507 | 1/1989 | Hrabal | 417/297 |
| 4,869,291 | 9/1989 | Hrabal | 417/297 |

*Primary Examiner*—Leonard E. Smith
*Assistant Examiner*—John A. Savid, III
*Attorney, Agent, or Firm*—Darby & Darby

[57] ABSTRACT

Hydraulic pump with axial pistons (1) in which each piston (1) forces the hydraulic liquid through a nonreturn valve, said nonreturn valves being connected to a control jack (20) by means of which the nonreturn valves can be made inactive, characterized by the fact that the nonreturn valves are placed in a chamber (10) and consist of a sliding support (15) inside of which there is disposed a spring (17) acting on an organ (16) serving as valve, which slides inside the sliding support (15), the latter being able, at will, to be coupled by any suitable means to the control jack (20).

16 Claims, 8 Drawing Sheets

Figure 1:
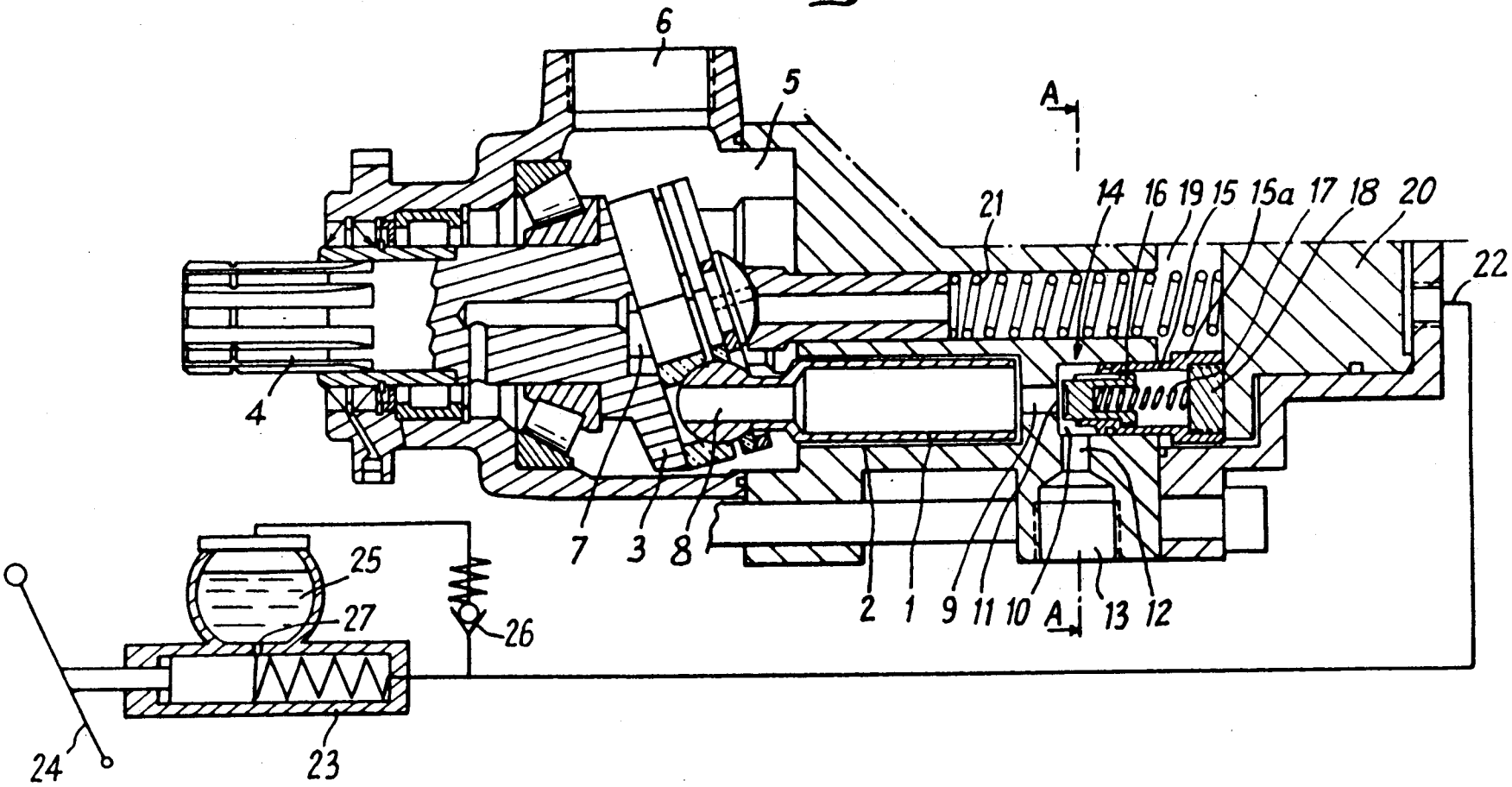

A
A
1
2
3
4
5
6
7
8
9
10a
10b
10c
10d
10e
10f
11
12
12a
12b
12c
12d
13a
13b
15
16
18
20
30a
31
32
34
35
36
39
40
41
42
43
44
46
48
49
53
55
56

HYDRAULIC PUMPS

The present invention concerns an improvement in hydraulic pumps that are equipped with check valves, of the nonreturn valve type.

When a pump of this type feeds a hydraulic equipment which operates intermittently, either a mechanical system is provided to disengage the drive of the pump or a hydraulic system which returns to the reservoir the liquid supplied by the pump when the equipment does not operate (hydraulic distributor or safety valve).

The solution that consists in sending the pumped liquid back to the reservoir in a continuous manner may, in certain cases, present the disadvantage that the liquid heats up, which makes it necessary to provide additional cooling means if it is to be avoided that the liquid reaches too high a temperature. Moreover, the circulation of the fluid necessitates consumption of energy; the energy is then spent as a total loss.

The solution that consists in disengaging the drive of the pump is better from the viewpoint of the problems of energy consumption and heating of the hydraulic liquid, but it requires burdensome mechanisms to be employed.

Another solution, known from German patent DE 3142230, consists in realizing the nonreturn valves by means of a star-shaped flexible part, each branch of which comprises outlet shutoff means, said star-shaped part being carried by a piston in a displaceable manner, thereby simultaneously disengaging all outlet orifices with the effect that the pump no longer has any discharge.

This somewhat simplistic arrangement is not suitable for high-pressure pumps, that is, pumps supplying pressures above 200 bars and as much as 1000 bars.

Besides, this arrangement does not allow selective control of certain valves that would permit, in the case of a multi-discharge pump, abolishing one discharge while maintaining the others.

According to the present invention, the check valves whose taking in and out of operation is to be controlled consist of a closure element slidingly mounted in a support by being retained by a spring, said support being itself slidingly mounted in a seat provided in the pump body, said sliding support being connected by any suitable means to the piston of a control jack, in such a way that, by actuating said control jack, the support or supports connected to it is/are made to slide, thereby taking the respective nonreturn valve(s) out of operation.

According to a first form of realization, it is provided to inactivate all check valves simultaneously so that the pump supplies zero discharge.

According to a second form of realization concerning a multi-discharge pump, it is provided to inactivate only the check valves of certain discharges so that some discharges are abolished while the others are maintained.

According to a third form of realization, means are provided whereby the taking out of service of the valves is made sequential, so that one obtains an abolishment or a progressive restoration of the discharge(s) of the pump.

Figure 2:
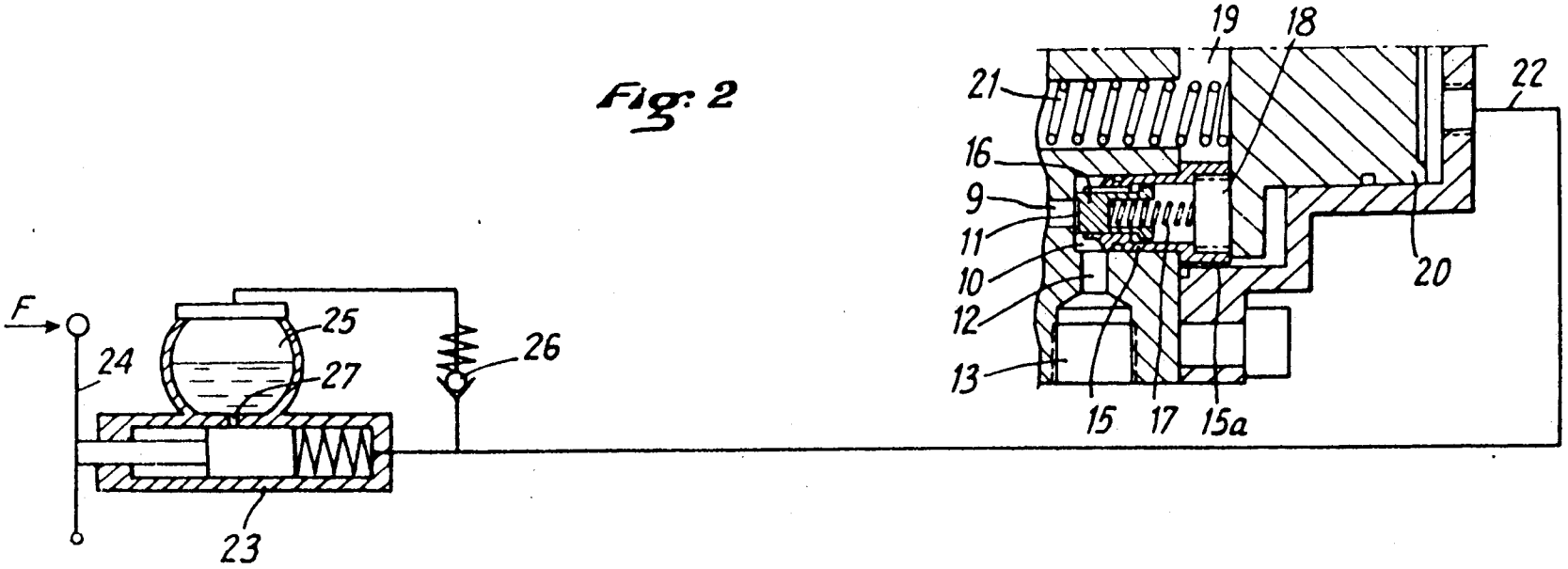
Figure 3:
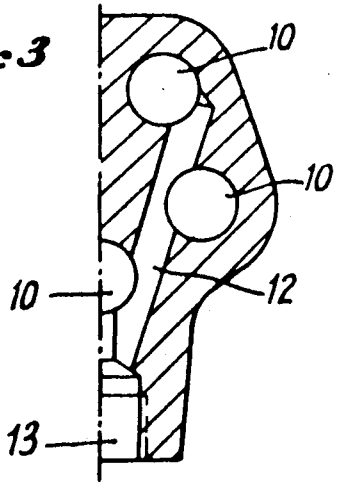
Figure 4:
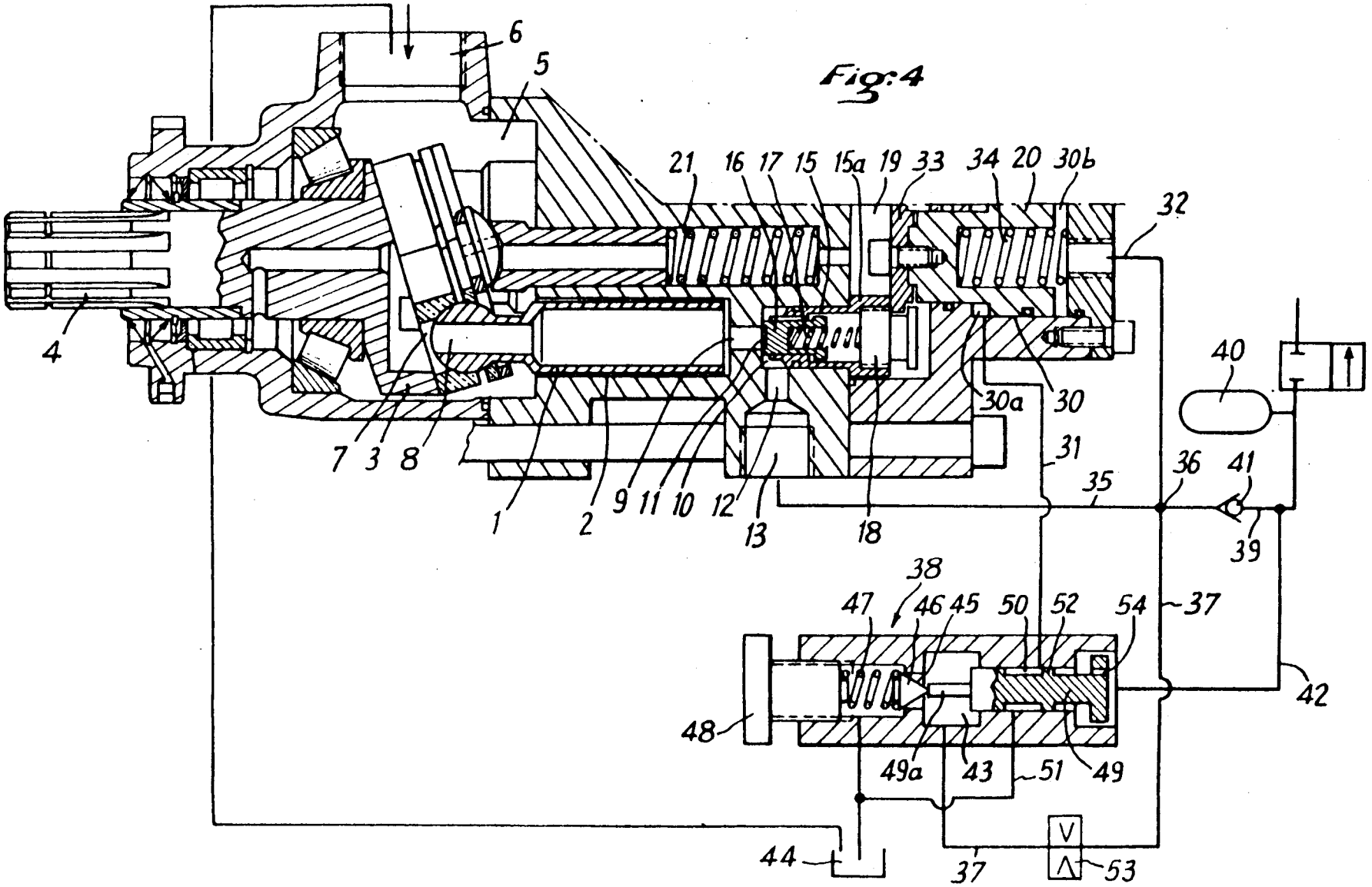
Figures 5, 6:
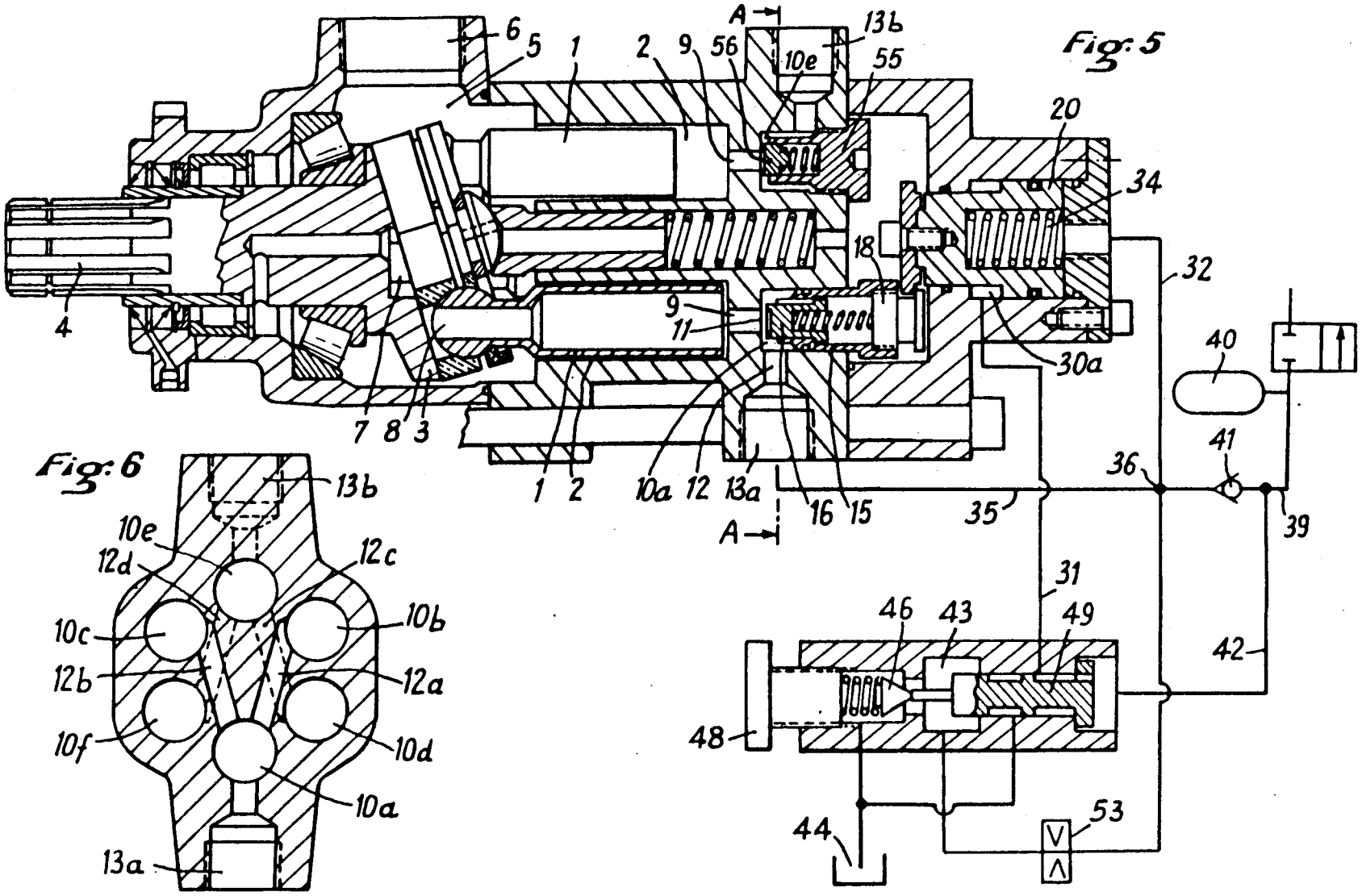
Figure 7:
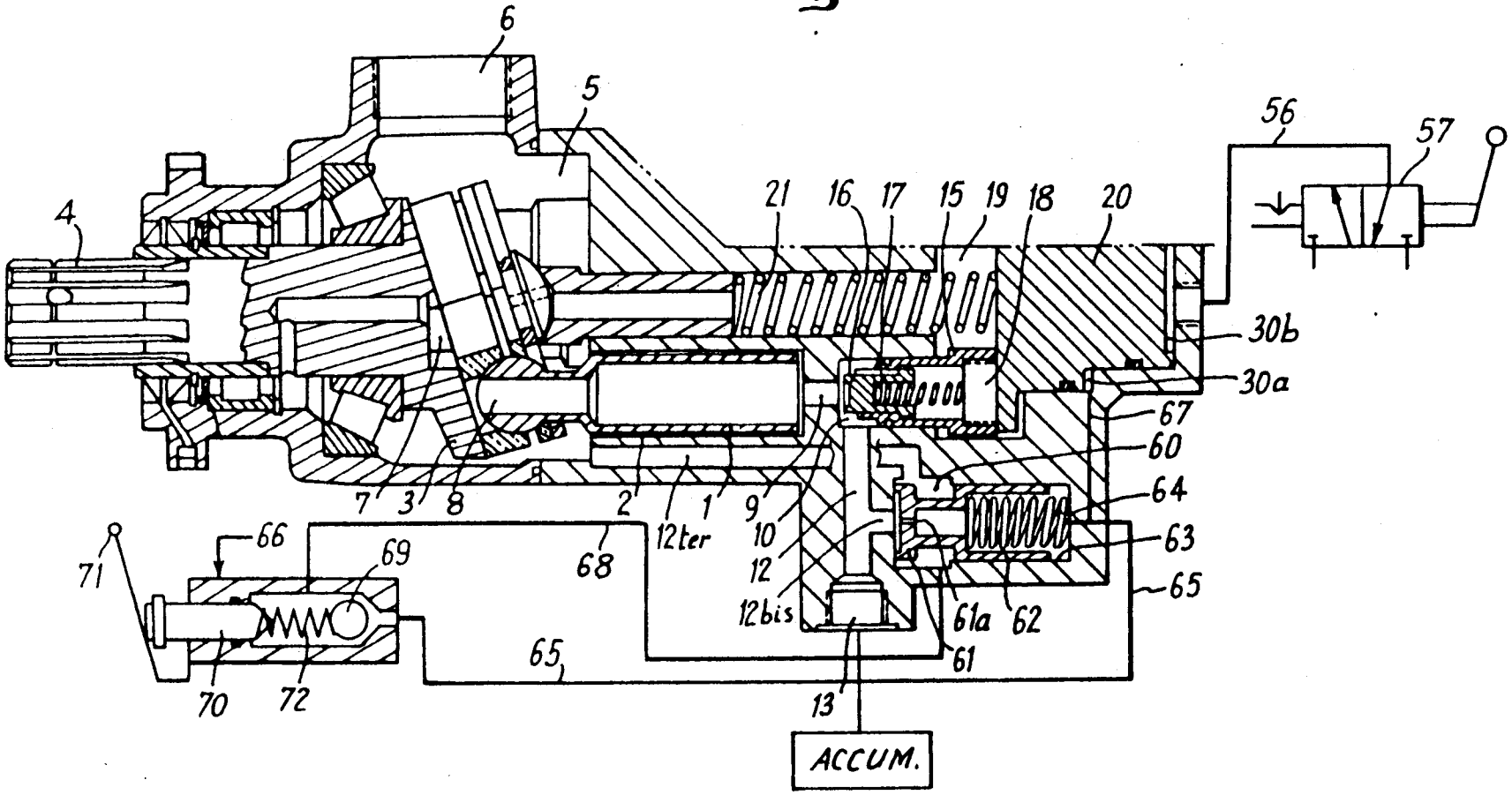
Figures 8, 9:
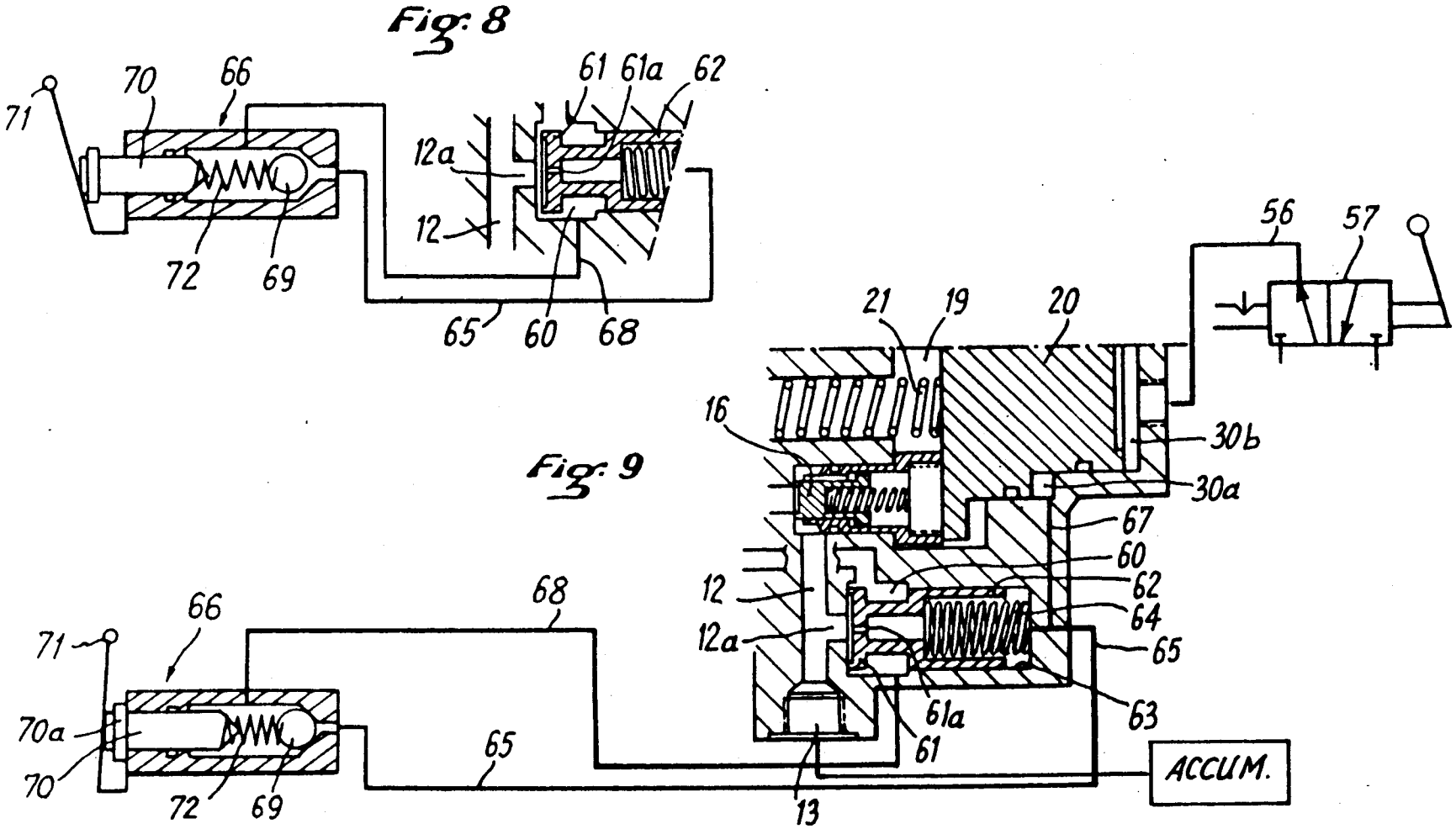
Figure 10:
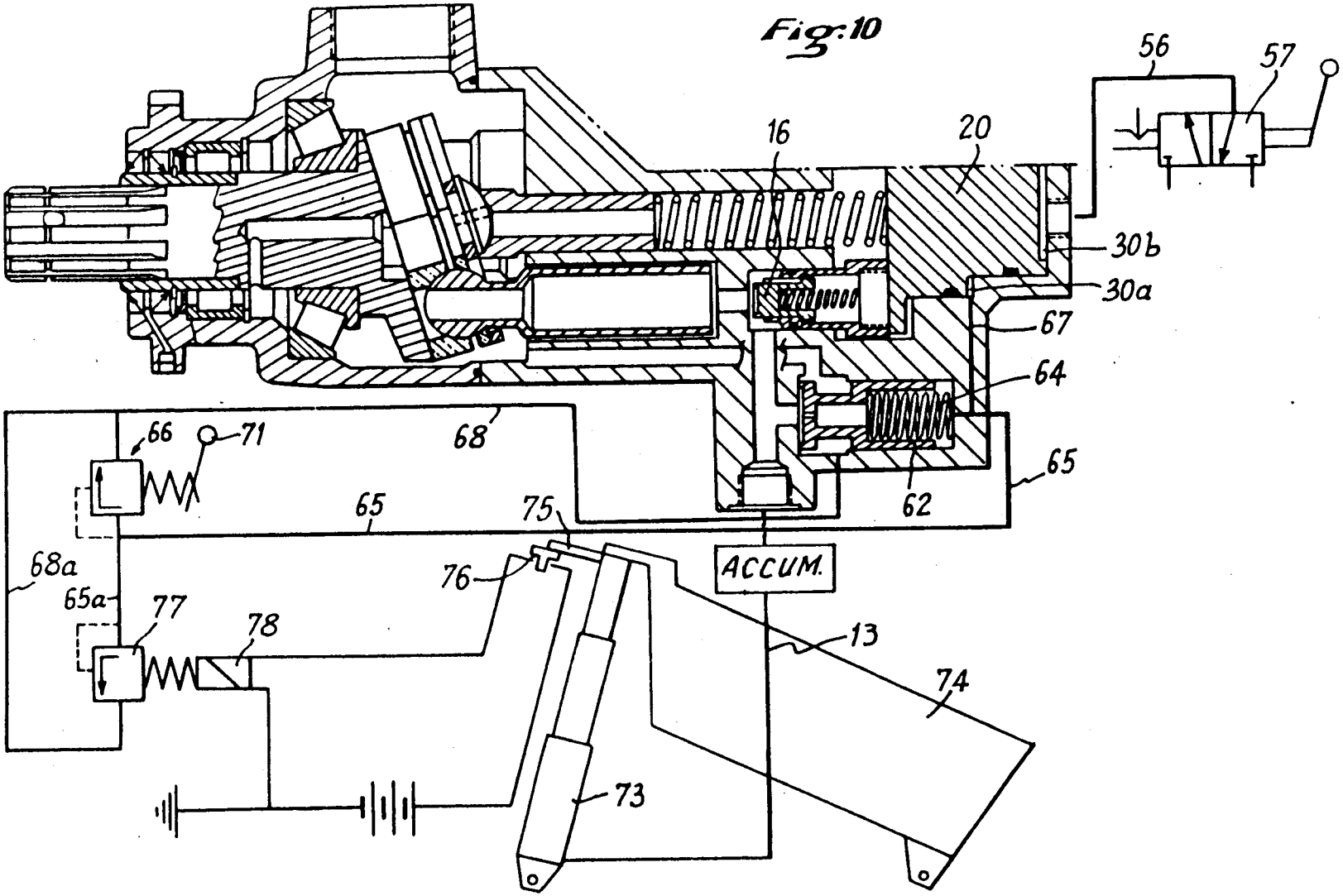

By way of example and to facilitate comprehension of the invention, there are shown in the annexed drawings:

FIG. 1, a partial view in section of an embodiment example of the invention;

FIG. 2, a partial view of FIG. 2 illustrating the change of position of a valve;

FIG. 3, a view in section along AA of FIG. 1;

FIG. 4, a partial view in section of a first variant of realization;

FIG. 5, a view of a variant of FIG. 4;

FIG. 6, a view in section along AA of FIG. 5;

FIG. 7 to 9, three views in section illustrating a second variant of realization of the pump according to the invention;

FIG. 10, a schematic view representing a power supply circuit of the tipping truck lifting jack fed by a pump according to FIGS. 7 to 9.

Figure 11:
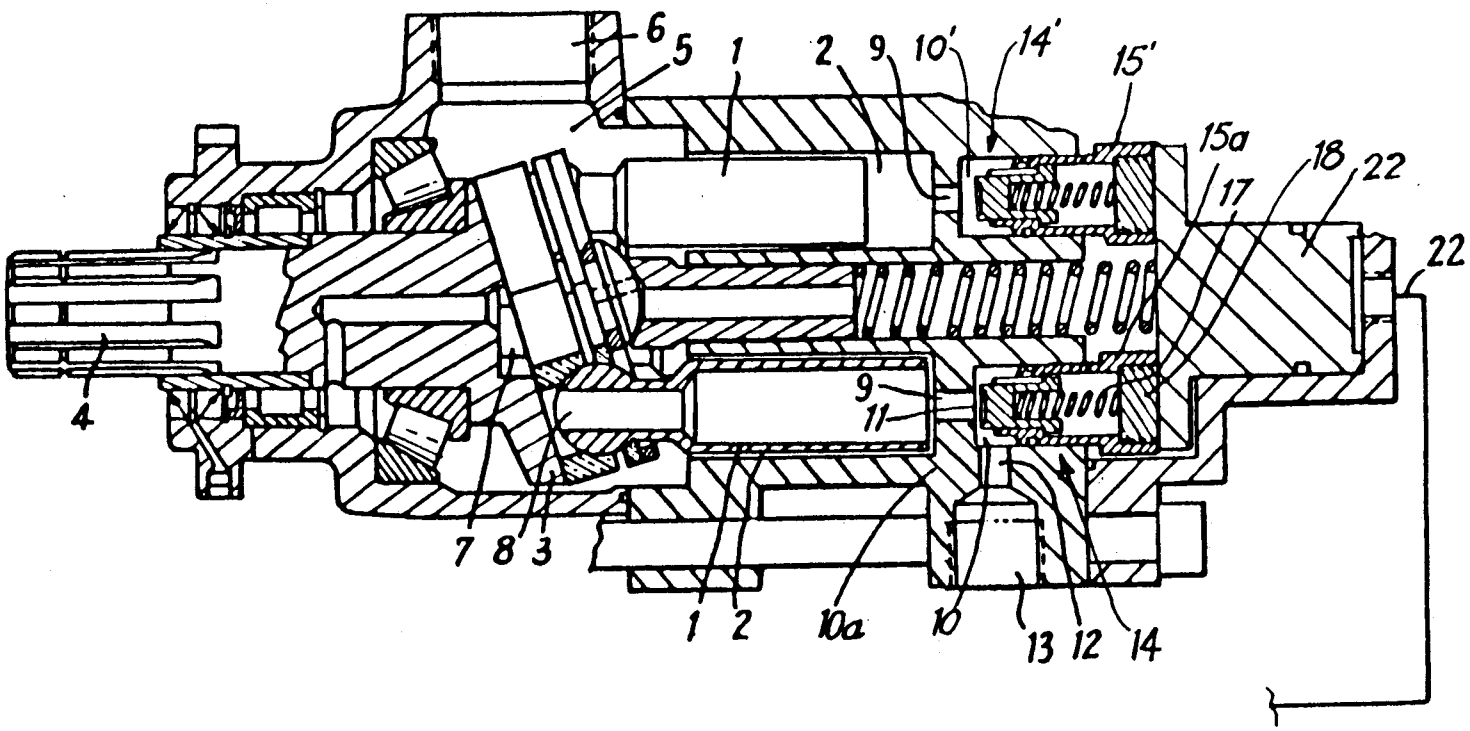

FIG. 11 is a view similar to FIG. 1, showing an alternative embodiment of the invention.

Referring to FIGS. 1 to 3, it is seen that the hydraulic pump comprises, in a manner known in itself, a plurality of hollow pistons 1 which slide in cylinders 2 under the action of a skew plate 3 driven in rotation by a shaft 4. The hydraulic liquid arrives in the admission chamber 5 of the pump through an orifice 6. During the intake stage, the hydraulic liquid passes through a passage 7 cut in the skew plate 3 and penetrates into the head 8 of piston 1 which it traverses so as to fill the piston 1 which is hollow. During the backpressure stage, the communication between the head 8 of the piston and the passage 7 is interrupted and the liquid is forced through the conduit 9 which through an orifice 11 leads into a chamber 10 into which leads also a conduit 12 that communicates with an outlet orifice 13. Chamber 10, between the conduits 10 (sic) and 12, contains a nonreturn valve indicated by the general reference 14. The liquid forced by the movement of piston 1 raises said valve and gets to the outlet orifice 13 through conduit 12. As is shown in FIG. 3, all chambers 10 of the pump are connected to one another by the conduits 12.

This arrangement is common and widely known.

When the pump feeds an intermittently operating hydraulic apparatus, either mechanical means are provided for disengaging the drive of shaft 4, or hydraulic means, as for example a hydraulic distributor assuring the return of pump the liquid pumped by the pistons 1 toward the reservoir (not shown).

According to the pump present invention, the check valve 14 consists of a hollow body 15 which is coaxial with the chamber 10 so as to be able to slide in chamber 10 along this axis. Inside the hollow body 15 there is slidingly mounted the actual valve 16, which is retained by a spring 17 applying against a plug 18 secured to the sliding hollow body 15.

Each sliding hollow body 15 projects, at its end 15*a*, opposite the valve 16, into a chamber 19 in which moves a piston 20. This piston 20 is subjected on one side to a return spring 21 and on the other to a hydraulic pressure, admitted by a conduit 22, originating from a hydraulic transmitter 23, actuated by a control 24.

When the control 24 is actuated along arrow F, as shown in FIG. 2, the hydraulic transmitter 23 acts through conduit 22 to push piston 20 back against spring 21. The piston 20 causes all sliding hollow bodies 15 to slide in their chambers 10, with the effect that the valves 16 shut the orifices 11 of the conduits 9. In this position, all valves 16 become active, that is, they fulfill normally their function as non-return check valves when shaft 4 is driven. The liquid forced by each of the pistons 1 lifts the corresponding valve 16 against its spring 17, and the hydraulic liquid follows the manifold 12 to leave through the outlet orifice 13.

When the control 24 is set in the position shown in FIG. 1, spring 21 pushes piston 20 back; the hydraulic liquid behind piston 20 is forced through conduit 22 and gets to the reservoir 25 across the non-return valve 26. In this position, the reservoir 25 communicates with the chamber of the hydraulic transmitter 23 through the orifice 27. The withdrawal of piston 20 has the result that the valves 16 are no longer held applied against their seat, at the bottom of chamber 10, so that the assembly valve 16—hollow body 15 is pushed back by the liquid discharged by each piston 1 and the conduits 9 all communicate with one another through the manifolds 12. It follows that the liquid forced by the pistons 1 in the backpressure stage penetrates freely into the bores 2 of the other pistons 1 which are in the intake stage and that thus the pump delivers zero flow. Hence there is no loss of energy and no heating of the liquid although the pump is still being driven by shaft 4.

Thus, for example, if the pump is intended to feed the jack for lifting a tipping truck box, it is no longer necessary to provide a mechanical engagement control for the shaft 4 of the pump, as is done at present. The pump is continuously driven by the transmission of the truck, control 24 being in the position shown in FIG. 1. When the driver of the truck wishes to actuate the pump box, it suffices for him to act on the control 24 in the direction of arrow F to bring it into the position shown in FIG. 2; the valves 16 are then all brought back into active position by the piston 20 and the pump furnishes the flow and hydraulic pressure required for manipulating the box.

Naturally the invention is not limited to this particular application, which is mentioned only by way of example to illustrate the advantage of the arrangement of the present invention as compared with the known previous devices.

FIGS. 4 to 6 illustrate two variants of realization in which the same elements bear the same references.

In these variants, the movement of the piston 20 which controls the operation of the nonreturn valves is reversed relative to the previous example in the sense that, in the absence of any pressure behind piston 20, the valves are active and they are deactivated when piston 20 is subjected to a hydraulic pressure.

In this case, piston 20 is a double-action piston. It slides in a bore 30 which is connected on the one hand to a conduit 31 discharging into the chamber **30*a* and on the other hand to a conduit 32 discharging into the chamber 30*b***.

The piston 20 has a gripping organ 33 which engages in a groove cut behind each plug 18. Besides, piston 20 is no longer subjected to the influence of the spring 21 but to that of a spring 34 which is arranged in the opposite direction. It follows that when piston 20 is displaced from left to right by the pressure arriving in chamber **30*a*, it compresses the spring 34 and takes along by the organ 33 the plugs 18 and hence the hollow bodies 15, and the valves 16 are disengaged from the orifices 11 and hence made inactive. On the contrary, under the action of spring 34, or of a pressure arriving in chamber 30*b*, the piston is displaced from right to left and the valves 16** are made active.

The outlet orifice 13 of the pump discharges the liquid under pressure into a conduit 35 which ends at a junction point 36. From this junction point 36 start three conduits—conduit 32, which ends in chamber **30*b*, conduit 37 which ends at a regulator 38, and conduit 39, which is the service conduit, ending at any hydraulic equipment not shown. On conduit 39 are disposed a nonreturn valve 41 and a hydraulic accumulator 40. Conduit 39 communicates also with the regulator 38 by a conduit 42 situated between the hydraulic accumulator 40 and the nonreturn valve 41**.

The regulator 38 is intended to fulfill the function of a circuit-breaker. To this end it comprises a safety valve and a control slide valve. Conduit 37 opens into a chamber 43 which communicates with the reservoir 44 through an orifice 45 closed by a valve 46 retained by a spring 47, tightened by an adjustable stop 48. On the other side of chamber 43 a slide valve 49 is disposed which receives at its other end the pressure arriving through conduit 42; the slide valve 49 slides in a bore 50 connected on the one hand to conduit 31 (and hence to chamber **30*a*) and on the other hand to the reservoir 44 through conduit 51, said conduits 31 and 51 being separated or made to communicate by a partition 52 carried by the slide valve 49**.

The operation of the device thus described is explained below.

When shaft 4 is driven, the skew plate 3 imparts to the pistons 1 a reciprocating movement; the liquid arriving through the orifice 6 of the reservoir 44 penetrates into the pistons 1 through the passage 7 and the heads of the pistons and is forced by the pistons into the conduits 9.

Piston 20 is pushed back by spring 34 so that all valves 16 are in active position on their respective orifices 11. The liquid under pressure comes out of the pump through orifice 13 and through conduit 35 arrives at the junction point 36. The liquid under pressure arrives through conduit 32 at the back of piston 20 in chamber **32*b* and adds its action to that of the spring 34. The liquid under pressure follows conduit 39 and, across the valve 41, charges the accumulator 40. The liquid under pressure also arrives at the chamber 43 of the circuitbreaker 38 through conduit 37 traversing a calibrated passage 53**.

The slide valve 49 receiving the high pressure on its two faces through the conduits 37 and 42 is in equilibrium position.

When the pressure reaches a predetermined maximum value, which corresponds to the maximum charge value of the accumulator 40, valve 46 opens and brings chamber 43 into communication with the reservoir 44. The liquid which runs out of chamber 43 is replaced by liquid coming from conduit 37; this flow, passing across the calibrated passage 53, undergoes a pressure loss, so that the pressure applied through conduit 42 on one of the faces (at right in the figure) of slide valve 49 is higher than that applied through conduit 37 on the other face, thereby producing a displacement of slide valve 49, which by its rod **49*a* keeps valve 46 open and which by its partition 52 interrupts the communication between conduits 31 and 51. Slide valve 49 has a hole 54 which lets the pressure arriving through conduit 42 get to the partition 52 and therefore, when slide valve 49 has moved, and communicates with conduit 31 and consequently with chamber 30*a***.

As chamber **30*a* is under pressure, while chamber 30*b* is connected to the reservoir by conduit 32, chamber 43, and valve 46, which is kept open by rod 49*a*, the result is that piston 20 moves from left to right in FIG. 4 taking along the hollow bodies 15 and the valves 16 which become inactive. From that moment on, the pump no longer supplies any flow. The pressure falls in the conduits 32, 35, 37**.

The hydraulic pressure prevailing in the accumulator 40 closes the valve 41 and through the conduit 42, the orifice 54 and the conduit 31 maintains the piston 20 in the position in which it makes the valves 16 inactive. Apart from the internal leaks, there is no longer any circulation of fluid upstream of the nonreturn valve 41.

The hydraulic accumulator 40 furnishes to the hydraulic equipment, not shown, located downstream, the hydraulic liquid under pressure necessary for its operation. As this hydraulic liquid under pressure is not replenished by the pump which no longer produces any flow, the pressure falls progressively so that the valve 46 returns to its original position, which brings chamber 30*a* into connection with the reservoir 44 through the conduits 31 and 51; piston 20 returns to starting position and the pump resumes delivery.

Thus an automatic control is obtained by means of which the pump furnishes a flow under pressure only when that is necessary.

By way of example, such an arrangement can be used advantageously for the control of assisted steering of a motor vehicle. Assisted steering is necessary practically only to perform the manipulations for parking a vehicle, that is, when the engine is in slow motion and its speed is practically zero. It follows that it is necessary to design the components of the hydraulic circuit so that they can furnish much power when the engine is in slow motion, for example 800 rpm. When the vehicle runs on the road at high speed, the steering efforts are minimal when the engine runs much faster, for example at 4,000 rpm, which means that the hydraulic pump furnishes a power five times greater. Hence there is considerable waste of energy and a real danger of the hydraulic liquid heating up, so that cooling devices must be provided. With the device thus described, the steering system functions with the accumulator on the road, said accumulator being recharged regularly, the pump not furnishing any flow most of the time.

Obviously the invention is not limited to this particular application, which is given only to illustrate the advantage obtained by the invention.

FIGS. 5 and 6 represent a variant of realization of the device of FIG. 4 in which the same elements bear the same references. In this example, the hydraulic pump is a pump with two discharges, that is, it has six pistons 1 which force the liquid into six chambers 10, the chambers 10*a*, 10*b*, 10*c* being interconnected by manifolds 12*a* and 12*b* (which) discharge into an outlet orifice 13*a*, while the chambers 10*d*, 10*c* (sic), 10*f* are interconnected by manifolds 12*c* and 12*d* which discharge into an outlet orifice 13*b*. One thus obtains two different outlet flows, independent of each other(,) one at 13*a* and the other at 13*b*.

As can be seen in FIG. 5, the bodies 55 of the valves 56 of the chambers 10*d*, 10*c* (sic) and 10*f* are screwed and hence are fixed; while the bodies 15 of the valves 16 of the chambers 10*a*, 10*b* and 10*c* are movable and moved by the piston 20.

It follows that the pump described in FIGS. 5 and 6 furnishes two flows of which one, through the outlet orifice 13*b*, is constant while the other, through the outlet orifice 13*a*(,) is intermittent.

According to another variant of realization which is not represented, because it is very easy to understand, the various chambers 10 in which slide the hollow bodies 15 carrying the nonreturn valves 16 can be arranged in such a way that their respective depths are different; thus, when piston 20 moves, the valves 16 will not all shut their respective orifices 11 simultaneously but will shut them one after the other sequentially. One thus obtains a progressive taking into and out of operation of the pump, which may be particularly advantageous.

It has been explained before that the device shown in FIGS. 1 to 3 could advantageously be employed for feeding the jack for lifting a truck tipping box. FIGS. 7 to 10 represent a preferential mode of carrying the invention into effect for this particular use.

In these figures, the elements identical with those of the preceding figures bear the same references.

The chamber 30*b* of the jack 20 is connected by a conduit 56 to a control distributor 57. In the example represented, the distributor 57 is connected to the source of compressed air of the truck, but it could be connected to a hydraulic source.

The manifold 12 has, just upstream of the outlet 13 (which feeds the jack for lifting the box) a branch 12*bis* which ends in a chamber 60 which is connected by a hole 12*ter* to the admission chamber 5. This conduit 12*bis* is closed by a piloted valve 61 which is integral with a hollow piston 62 sliding in a bore 63 and retained by a spring 64. The valve 61 is pierced in its center by a calibrated orifice 61*a* of very small diameter.

The bore 63 is connected by a conduit 65 to a control valve 66 and by a conduit 67 to the chamber 30*a* of jack 20. The control valve 66 is connected to the chamber 60, ahead of piston 62, by a conduit 68. The control valve 66 has a ball 69, actuated by pusher 70, moved by a handle 71, with interposition of a spring 72 between the pusher 70 and the ball 69.

In FIG. 7 it is seen that when the jack 20 is pushed back by the spring 21, the flow is zero. The piloted valve 61 is in closed position.

In FIG. 8 it is seen that the control 57 has been taken into operation. The chamber 30*b* is then fed (with compressed air for example) and jack 28 is pushed back: The discharge valves 15 are then all in active position. The pressure arising with the forcing of the pump lifts the valve 61 and the pressure delivered returns through conduit 12*ter* into the admission chamber 5.

Referring to FIG. 9, it is seen that when the control 66 is actuated, ball 69 closes the communication between the conduits 65 and 68. The hydraulic liquid which passes through the hole 61*a* ends up in the bore 63, the chamber 30*a* and the conduit 65. As the latter is shut by the ball 69, the pressure rises in the bore 63 and this pressure pushes back, with spring 64, the valve 61 which shuts the conduit 12*a*, the high pressure is then sent through conduit 13 to the hydraulic receiver (jack 73, FIG. 10).

Depending on the force which he exerts on the handle 71, the user will be able, at will, to modulate the pressure that arrives at the jack 73. If the handle is barely pushed and the spring 72 barely compressed, the pressure arriving at 65 will raise the ball 69, will arrive through 68 in the chamber 60 and push back the piston 62 by opening the valve 61, causing the pressure to drop until the ball 69 closes the conduit 65 again. The maximum pressure is obtained when the shoulder 70*a* of the pusher 70 applies against the body of valve 66.

Referring to FIG. 10 in which are shown the jack 73 and box 74, it is seen that a limit switch can be provided.

The box 74 has a finger 75 which, at end of stroke, acts on a microswitch 76 which controls a valve 77 by a solenoid 78. This valve 77 restores the communication between the conduits 65 and 68 by the branches 65*a* and 68a by passing around the control 66. We are then in the same case again as when ball 69 is in full open position.

I claim:

1. A hydraulic pump with an inlet and an outlet and comprising:

a plurality of pump pistons each communicating with a respective chamber having an outlet to the pump outlet;

means for driving said pump pistons to force hydraulic fluid from the chamber outlets to the pump outlet;

a respective nonreturn valve between the outlet of each said chamber and the pump outlet for opening and controlling the associated chamber outlet, each said valve being slidable between a first position where it controls discharge from said chamber and a second inactive position where said chamber outlet is continuously open;

a slidable control piston contacting said valve to move the slidable nonreturn valve of each chamber to said positions to open or control the chamber outlet; and means for controlling the movement of said control piston, said controlling means operating the control piston to cause the nonreturn valves to be one of opened and controlling sequentially to progressively suppress and restore pump delivery.

2. A hydraulic pump as in claim 1 wherein said nonreturn valve comprises a sliding support against which the control piston acts, a valve element which slides within said sliding support, and a spring within the support acting on said valve element.

3. A hydraulic pump as in claim 2 in which selected ones of the slidable valve supports are fixed, the outlets of the chambers with the fixed supports communicating with a first outlet passage to provide a constant pump discharge and the outlets of the chamber with the moveable supports communicating with a second outlet passage to provide an intermittent pump discharge as determined by the operation of the control piston.

4. A hydraulic pump as in claim 3, wherein the number of said chambers is six, three said chambers being associated with fixed slidable valve supports and three said chambers being associated having movable valve supports.

5. A hydraulic pump as in claim 1 further comprising a pressure regulating valve at the outlet of a nonreturn valve, the outlet of the pressure regulating valve communicating with the entry to the pump piston.

6. A hydraulic pump as in claim 5 wherein the outlets of all of said nonreturn valves are coupled to an outlet manifold, the pressure regulating valve communicating with said manifold.

7. A hydraulic pump as in claim 6 further comprising a pilot valve coupled to said pressure regulator to control the operation of the pressure regulator to set the hydraulic pressure in the pump outlet manifold.

8. A hydraulic pump as in claim 2 wherein said controlling means operates the control piston to cause all of the nonreturn valves to open or control the chamber outlets at substantially the same time.

9. A hydraulic pump as in claim 2 wherein said controlling means operates the control pistons to cause only selected ones of said valves to open or control the corresponding chamber outlets so that at least a part of the pump output discharge can be eliminated.

10. A hydraulic pump as in claim 1, wherein the number of pump pistons is six and the number of control pistons is one.

11. A hydraulic pump with an inlet and an outlet and comprising:

a plurality of pump pistons each communicating with a respective chamber having an outlet to the pump outlet;

means for driving said pump pistons to force hydraulic fluid from the chamber outlets to the pump outlet;

a respective nonreturn valve between the outlet of each said chamber and the pump outlet for opening and controlling the associated chamber outlet, each said valve being slidable between a first position where it controls discharge from said chamber and a second inactive position where said chamber outlet is continuously open;

a slidable control piston contacting said valve to move the slidable nonreturn valve of each chamber to said positions to open or control the chamber outlet; and means for controlling the movement of said control piston;

the sliding distance between said first and second positions of the slidable nonreturn valve of each chamber outlet being different so that the valves move to the open and control positions sequentially.

12. A hydraulic pump with an inlet and an outlet and comprising:

a plurality of pump pistons each communicating with a respective chamber having an outlet to the pump outlet;

means for driving said pump pistons to force hydraulic fluid from the chamber outlets to the pump outlet;

a respective nonreturn valve between the outlet of each said chamber and the pump outlet for opening and controlling the associated chamber outlet, each said valve being slidable between a first position where it controls discharge from said chamber and a second inactive position where said chamber outlet is continuously open;

a slidable control piston contacting said valve to move the slidable nonreturn valve of each chamber to said positions to open or control the chamber outlet; and means for controlling the movement of said control piston;

said controlling means comprises:

an outlet conduit for the pump;

a first nonreturn valve and accumulator coupled to said outlet conduit;

said control piston being of the double acting type in a chamber having first and second sections;

a pressure regulator communicating with said first chamber section; and an outlet conduit providing communication between said second chamber section and a junction point upstream of said first nonreturn valve;

a conduit connecting the junction point to the pressure regulator, and a conduit connecting the accumulator to the pressure regulator;

a receiving means downstream of the junction point for utilizing the hydraulic pressure;

the pressure in the accumulator acting through the pressure regulator when reaching a predetermined pressure operating the control piston to control all said nonreturn valves and when dropping below said predetermined pressure to open said nonreturn valves.

13. A hydraulic pump with an inlet and an outlet and comprising:

a plurality of pump pistons each communicating with a respective chamber having an outlet to the pump outlet;

means for driving said pump pistons to force hydraulic fluid from the chamber outlets to the pump outlet;

a respective nonreturn valve between the outlet of each said chamber and the pump outlet for opening and controlling the associated chamber outlet, each said valve being slidable between a first position where it controls discharge from said chamber and a second inactive position where said chamber outlet is continuously open;

a slidable control piston contacting said valve to move the slidable nonreturn valve of each chamber to said positions to open or control the chamber outlet; and means for controlling the movement of said control piston;

a manifold at the outlet of each said nonreturn valve chamber;

a pair of check valves coupled to the manifold and control means for operating said pair of check valves in a manner such that one is open while the other is closed;

said control piston being of the double acting type;

each of said check valves having an outlet communicating with a respective section of said control piston to move it one direction or the other to close or open the nonreturn valve associated with the control piston depending on which of said pair of check valves is open or closed.

14. A hydraulic pump with an inlet and an outlet and comprising:

a plurality of pump pistons each communicating with a respective chamber having an outlet to the pump outlet;

means for driving said pump pistons to force hydraulic fluid from the chamber outlets to the pump outlet;

a respective nonreturn valve between the outlet of each said chamber and the pump outlet for opening and controlling the associated chamber outlet, each said valve being slidable between a first position where it controls discharge from said chamber and a second inactive position where said chamber outlet is continuously open;

a slidable control piston contacting said valve to move the slidable nonreturn valve of each chamber to said positions to open or control the chamber outlet; and means for controlling the movement of said control piston;

a pressure regulating valve at the outlet of a nonreturn valve, the outlet of the pressure regulating valve communicating with the entry to the pump piston, the outlets of all of said nonreturn valves being coupled to an outlet manifold, said pressure regulating valve communicating with said manifold, said outlet manifold being connected to said pump outlet;

a pilot valve coupled to said pressure regulator to control operation of said pressure regulator to set a level of hydraulic pressure in said pump outlet manifold;

said pilot valve comprises a cylinder with an outlet coupled to said pressure regulator, a ball serving as the valve sealing element biased by a spring and a manually actuated control rod, the pressure on the control rod controlling the seating of the ball and the pressure returned to said pressure regulator.

15. A hydraulic pump as in claim 14, further comprising a tipping box coupled to the pump outlet whose position is controlled by the pump output in accordance with the actuation of the control rod.

16. A hydraulic pump as in claim 15 further comprising a limit switch associated with said tipping box;

an electrically operated valve coupled to said control valve and controlled by said limit switch;

actuation of the limit switch by said tipping box causing the electrically operated valve to disable the control valve and thereby open the pressure-regulating valve.

* * * * *